US006700561B1

(12) United States Patent
Christensen, Jr. et al.

(10) Patent No.: US 6,700,561 B1
(45) Date of Patent: Mar. 2, 2004

(54) GAMMA CORRECTION FOR DISPLAYS

(75) Inventors: Harold F Christensen, Jr., Saratoga, CA (US); Douglas Sojourner, Fremont, CA (US); Jeanne M Hermsen, Corvallis, OR (US); Xuemei Zhang, Mountain View, CA (US); Travis N Blalock, Charlottesville, VA (US)

(73) Assignee: Agilent Technologies, Inc., Palo Alto, CA (US)

( * ) Notice: Subject to any disclaimer, the term of this patent is extended or adjusted under 35 U.S.C. 154(b) by 142 days.

(21) Appl. No.: 09/703,418

(22) Filed: Oct. 31, 2000

(51) Int. Cl.[7] ..... G09G 3/36

(52) U.S. Cl. ..... 345/97; 345/89; 345/99; 345/204

(58) Field of Search ..... 345/89, 97, 99, 345/204, 94, 98

(56) References Cited

U.S. PATENT DOCUMENTS 5,489,918 A * 2/1996 Mosier ..... 345/89
5,623,281 A * 4/1997 Markandey et al. ..... 345/108
5,754,150 A * 5/1998 Matsui ..... 345/89
6,137,462 A * 10/2000 Kim ..... 345/94
6,249,269 B1 * 6/2001 Blalock et al. ..... 345/97
6,256,010 B1 * 7/2001 Chen et al. ..... 345/147
6,329,974 B1 * 12/2001 Walker et al. ..... 345/98
6,384,806 B1 * 5/2002 Matsueda et al. ..... 345/89

* cited by examiner

*Primary Examiner*—Steven Saras
*Assistant Examiner*—Fritz Alphonse
(74) *Attorney, Agent, or Firm*—Robert T. Martin

(57) ABSTRACT

A system and method for using gamma correction in a ferroelectric liquid crystal (FLC) display uses a reduced number of different increment values for generating a Vramp signal for the FLC display without noticeably increasing error. The increment values are based upon an inverse gamma curve having a selected gamma value. Using linear interpolation, the increment values are calculated with more increment values being calculated for the beginning of the curve than the flatter end portion of the curve. In addition, an illumination period and a balance period are used so that each pixel of the FLC display is on and off for the same amount of time. As a result, the average voltage across the FLC material is 0V.

6 Claims, 6 Drawing Sheets

GAMMA CORRECTION FOR DISPLAYS

FIELD OF THE INVENTION

The present invention relates generally to devices and methods for performing gamma correction of a display, and more particularly to devices and methods for accurately modeling an inverse gamma curve used to turn on and off pixels in a ferroelectric liquid crystal (FLC) display while maintaining an average voltage of zero volts or a null voltage across the FLC display.

BACKGROUND OF THE INVENTION

In an analog based pixel cell architecture, a pixel value representing the brightness of a pixel is stored as an analog voltage rather than in a digital representation. The higher the stored voltage corresponding to the pixel value, the brighter the pixel is. A more detailed description of analog based pixel cell architectures is provided in U.S. application Ser. Nos. 09/070,487 and 09/070,669, which are incorporated herein by reference.

In this analog pixel cell architecture, a control signal called Vramp is routed throughout the pixel array. The_ Vramp signal is a monotonically increasing signal. Initially, the pixel is in the "on" or_display state. When the voltage of the Vramp signal rises to a level equal to the voltage stored inside the pixel, the pixel output switches to the "off" state in which the pixel does not display. Each pixel in the array of pixels of a display will switch from "on" to "off" at a time relative to its own stored voltage.

If a first pixel stores, for example, twice the voltage as a second pixel, then the first pixel will be on for twice as long as the second pixel if the Vramp signal rises at a constant rate. A problem with this method is that doubling the length of time that the first pixel is on as compared to the second pixel does not mean the first pixel will appear twice as bright as the second pixel.

SUMMARY OF THE INVENTION

Briefly, in one aspect consistent with the present invention, a method for generating a Vramp signal to be applied to pixels of a display selects a first step value from a plurality of step values and adds the first step value to the Vramp signal for each of a first number of clock cycles. A second step value is selected from the plurality of step values and is added to the Vramp signal for each of a second number of clock cycles, different from the first number of clock cycles. The sample points used to determine the step values are preferably chosen to be close enough together that the slope over any region between sample points is not significantly different from the average slope, but far enough apart that memory is not wasted storing nearly identical values.

In another aspect consistent with the present invention, a method for generating a Vramp signal applied to pixels of a display selects sample points based upon an inverse gamma curve having a selected gamma factor. An average slope between each consecutive pair of selected sample points is then determined. A step value is calculated for each determined slope. One of the calculated step values is then added to the Vramp signal at each clock cycle. Each of the calculated step values is used for more than one clock cycle.

In a further aspect consistent the present invention, the Vramp signal is generated in an illumination period and in a balance period. In yet a further aspect of the present invention, the Vramp signal is applied to the pixels of the display such that each pixel of the display is in an on-state during the illumination period for the same amount of time each pixel is in an off-state during the balance period.

DETAILED DESCRIPTION OF THE PREFERRED EMBODIMENT

Figure 1:
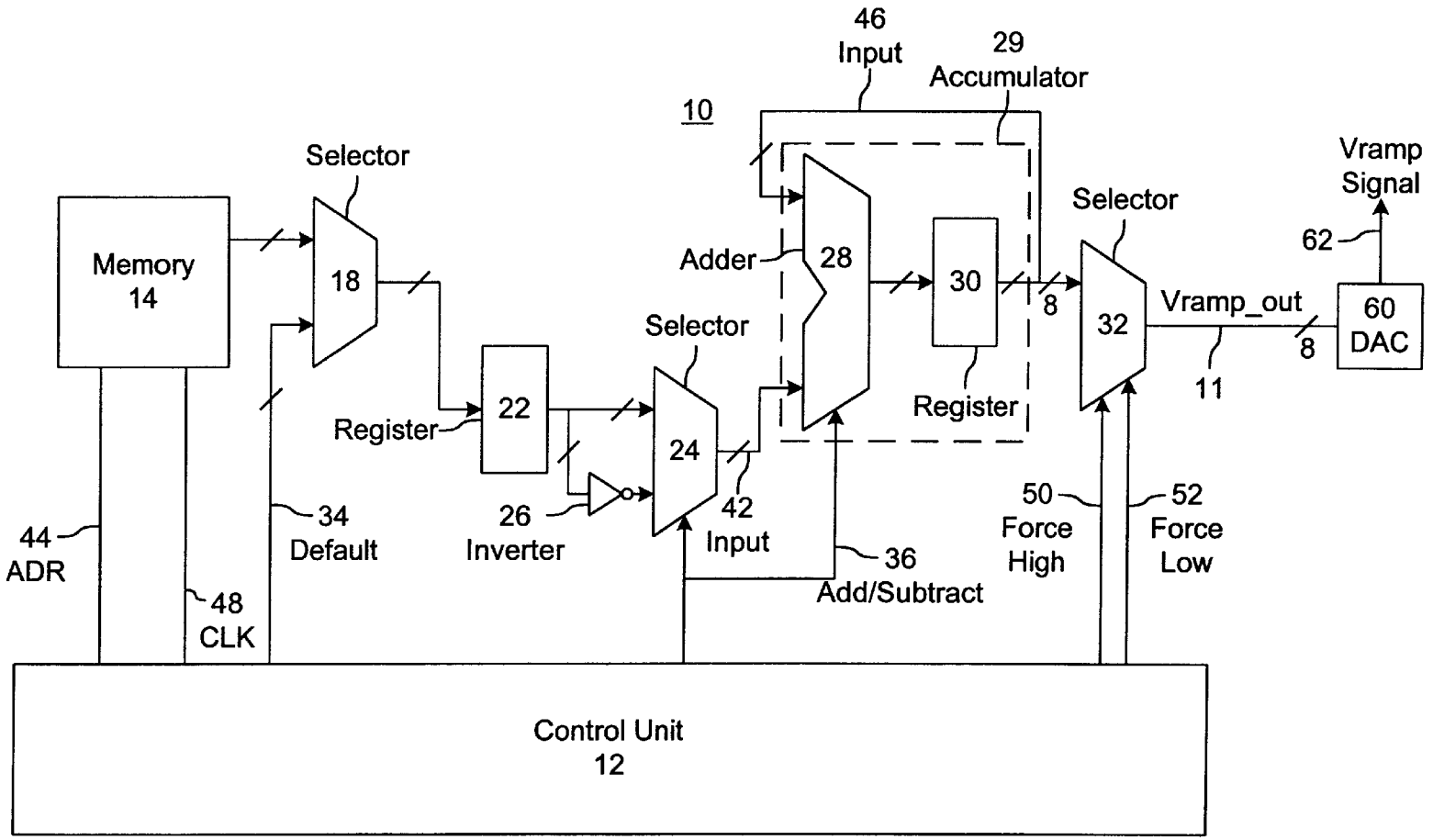
FIG. 1 is a block diagram of a Vramp generator consistent with the present invention.

In general, there may be 1024 time cycles per cycle of the Vramp signal. Each cycle of the Vramp signal corresponds to an illumination period in which the value of the Vramp signal rises from a minimum voltage Vmin to a maximum voltage Vmax, or to a balance period in which Vramp rises again from Vmin to Vmax or falls from Vmax to Vmin, depending upon a control signal. In each time cycle, also referred to as a clock cycle, the value of the Vramp signal rises by some increment, starting with Vmin at the first time cycle and rising to Vmax at the last time cycle. A simple method to increase the value of the Vramp signal is at a constant increment from Vmin to Vmax. With this method, if a first pixel should be, for example, twice the voltage as a second pixel, then the first pixel will be on for twice as long as the second pixel because the Vramp signal rises in constant increments. However, doubling the length of time that the first pixel is on compared to the second pixel does not mean the first pixel will appear twice as bright as the second pixel. This is because the relationship between the time that a pixel is on and its apparent brightness is non-linear.

In view of this non-linear relationship, it is desirable to apply gamma correction when generating the Vramp signal. Applying gamma correction to the generating the Vramp signal alters the relationship between the pixel voltage and the pixel on-time to better correlate voltage to apparent brightness.

CRTs have a brightness response that appears more linear, and that can be modeled by $B=B_0(a/255)^{\gamma}$, where B is the brightness, $B_0$ is the full scale brightness, "a" is the code to be represented (between 0 and 255) and $\gamma$ is a constant, typically between 1.5 and 3.0. This model has lead to calling the correction of the code to brightness relationship "gamma correction." The behavior described above corresponds to a $\gamma=1$. To model $\gamma>1$, the time a pixel is set to be on is determined according to the equation $T=T_0(a/255)^{\Psi}$, where $T_0$ is the full time of the Vramp. This means that at $T=T_0(a/255)_{\Psi}$, $Vramp=V(a)=V\,min+(a/255)(V\,max-V\,min)$ for V min≦V≦V max. If we simplify so that Vmin=0 and Vmax=1, then Vramp=a/255 for 0≦V≦1 or $$Vramp = (T/T_0)^{\frac{1}{\gamma}}.$$

In general, we want Vramp to be the inverse function of the desired relationship between "a" and B.

By using an inverse gamma curve to shape the Vramp signal, the values of the Vramp signal rise quickly at the beginning of the Vramp cycle and then much more slowly at the end. The result of using an inverse gamma curve to shape the Vramp signal is that, in the example of a first pixel storing twice the voltage of a second pixel, the first pixel will more closely appear to be twice as bright as the second pixel.

One way of modeling an inverse gamma curve is to use a look-up table that uses a linearly rising counter as an address. Each Vramp cycle is divided into a plurality of time cycles, such as 1024 time cycles. A counter counts the time cycles and can serve as the address to the look-up table. The values in the look-up table correspond to increments to the Vramp signal. These values are successively accumulated, time cycle by time cycle, resulting in a digital representation of the Vramp signal. The increments are derived from the inverse gamma curve by dividing the inverse gamma curve equally by the number of time cycles and determining the changes in the inverse gamma curve between consecutive time cycles.

The maximum curvature of the inverse gamma curves increases as the value of the gamma factor increases. For small values of the gamma factor, the maximum curvature of the inverse gamma curve is relatively small. Such an inverse gamma curve can be accurately approximated using increments having relatively few different values and by using the same increment over a number of time cycles. However, for larger values of the gamma factor, the maximum curvature of the inverse gamma curve is relatively large, and increments having far more different values are necessary to model the inverse gamma curve accurately. This is because the increment changes significantly between every time cycle. As increments having more different values are needed to model the inverse gamma curve accurately, the number of time points, and hence the amount of storage space required for the increments increases. Accordingly, to take advantage of the gamma correction, it is necessary to provide additional storage space to hold the data for the inverse gamma curve used to shape the Vramp signal.

FIG. 1 is a block diagram of one exemplary embodiment of a Vramp generator 10 consistent with the present invention. The Vramp generator 10 produces a Vramp_out signal at an output 11. The Vramp_out signal may be used by a digital to analog (DAC) converter 60 to produce a voltage value for the Vramp signal 62 applied to the pixel array. Among the components in the Vramp generator 10 are a control unit 12, a memory 14, selectors 18, 24 and 32, registers 22 and 30, an accumulator 29, which includes an adder 28, a register 30 and inputs 42 and 46, and an inverter 26. In addition, there are several signal lines between the control unit 12 and other components of the Vramp generator 10. These signal lines include an address line 44 and a clock line 48 applied to the memory 14, a default value line 34 applied to selector 18, an add/subtract line 36 applied to selector 24 and accumulator 29, and a force high line 50 and a force low line 52 applied to selector 32.

The data values used to generate the Vramp_out signal are stored in the memory 14. The memory 14 may be implemented as a ROM or other non-volatile storage if the data values are fixed. Alternatively, the memory 14 may be implemented as a RAM if the data values are changeable and loaded into the memory 14. As discussed below, the data values may be changeable in accordance with the changing of a gamma factor γ. The memory 14 may be formed as two or more separate storage units to allow loading of data into one storage unit while another storage unit is being used to produce the increments for generating the Vramp signal. The data values stored in the memory 14 are increments for the Vramp signal, hereinafter referred to as step values. Each step value can be used several times in a row, once per clock cycle. Assuming the clock or time cycles run from 0 to 1024, the step values are accumulated for the entire 1024 clock cycles in an illumination period.

Since a color display, such as an FLC display, typically displays three colors, red, green and blue, it is desirable to have step values for each color. If the sample points used to make the inverse gamma curves for modeling the Vramp signal are spaced evenly across the 1024 clock cycles, there are typically too few points in the early part of the curves because the curves have higher curvature at the beginning of an illumination period. As a result, errors may be most noticeable at the early part of the curve using an even spacing. If an increased number of sample points were used to model the early part of the curve, a larger storage would be required to hold the additional increment values. To accurately model the early part of the curve and reduce the amount of storage space for the increment values, uneven spacing of the sample points is used in the preferred embodiment of the invention.

To reduce the amount of storage space needed to hold the step values in the memory 14, the memory 14 is loaded with a reduced number of step values. This reduced number of step values is substantially less than the number of step values needed when a step value is provided for each clock period. In a preferred embodiment, there are 32 step values for each color. The step values may be generated by performing a piecewise linear interpolation of a chosen inverse gamma curve. The number of time cycles for which a step value is used may vary depending on the part of the curve being modeled. For example, the step values may be chosen to increase the accuracy in the early part of the curve, where the slope of the curve changes very rapidly, at the expense of the ending part where the slope of the curve changes relatively slowly. Table I below shows an example of the number of times that each step value is used and the time cycle number at which each step value is first used in a preferred embodiment.

TABLE I

| Step Value Number | Number of Time Cycles for Which Step Value Is Used | Time Cycle Number at which Step Value Is First Used |
|---|---|---|
| 1–2 | 2 | 0, 2 |
| 3 | 4 | 4 |
| 4 | 8 | 8 |
| 5–11 | 16 | 16, 32, 48, 64, 80, 96, 112 |
| 12–25 | 32 | 128, 160, 192, 224, 256, 288, 320, 352, 384, 416, 448, 480, 512, 544 |
| 26–32 | 64 | 576, 640, 704, 768, 832, 896, 960 |

(last point in curve = 1024)

Table I shows that the first and second step values are used twice each, the first one for the first two time cycles and the second one for the next two time cycles. After the first four time cycles, the third step value is used for the next four time cycles, and the fourth step value is used for eight time cycles thereafter. The fifth through eleventh step values are used for sixteen cycles each, and so on. In total, only 32 step values are used as increments instead of 1024.

Figure 2:
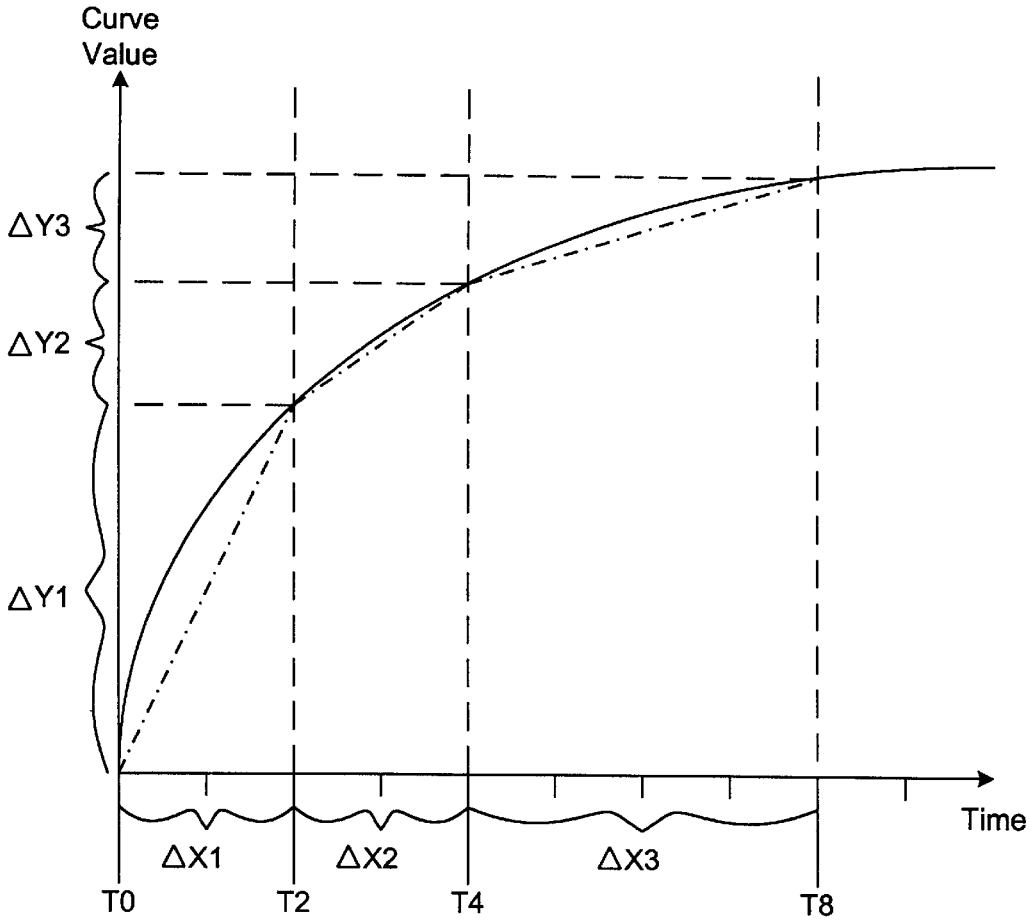
FIG. 2 is a graphical representation of an inverse gamma curve used to generate step values for the Vramp generator of FIG. 1.

FIG. 2 shows an exemplary inverse gamma curve from which the step values can be derived. As shown in FIG. 2, the inverse gamma curve is plotted relative to time, T, which is expressed as a number of time cycles. The curve can be modeled from the following basic equation:

$$V = \left(\frac{1}{1024^{\frac{1}{\gamma}}}\right) * T^{\frac{1}{\gamma}},$$

assuming Vmin=0 and Vmax=1, where V equals the value of the inverse gamma curve. The first part of this equation is a scaling factor to make the final point of the curve come out to 1. The second part of the equation takes a time cycle number and raises it to the inverse power of the gamma factor γ. The curve can be modeled in a preferred embodiment for gamma factors between 1 and 3 at a step of 0.1.

Once the inverse gamma curve has been established, the step values can be calculated. The step values may be calculated as a product of a scaling factor with the slope of a line formed from points sampled on the curve at selected ones of 1024 equally spaced time cycles. The slope is equal to the difference between the value of the curve at the sample points divided by the number of time cycles between those sample points. More specifically in a preferred embodiment, the calculation for each step value may be calculated as follows:

$$StepValue = \left(\frac{2^{14}-1}{1024^{\frac{1}{\gamma}}}\right) * \left(\frac{T_{n+m}^{\frac{1}{\gamma}} - T_n^{\frac{1}{\gamma}}}{T_{n+m} - T_n}\right)$$

where $T_n$ refers to the time value at n time cycles, and $T_{n+m}$ refers to the time value at n+m time cycles, which is the next sample point, m time cycles after the previous sample point at $T_n$. The first part of the step value corresponds to a scaling factor, and the second part of the step value corresponds to the slope between two points of the inverse gamma curve. The scaling factor is chosen so that all the bits are one when the step value is at a maximum.

Figure 3:
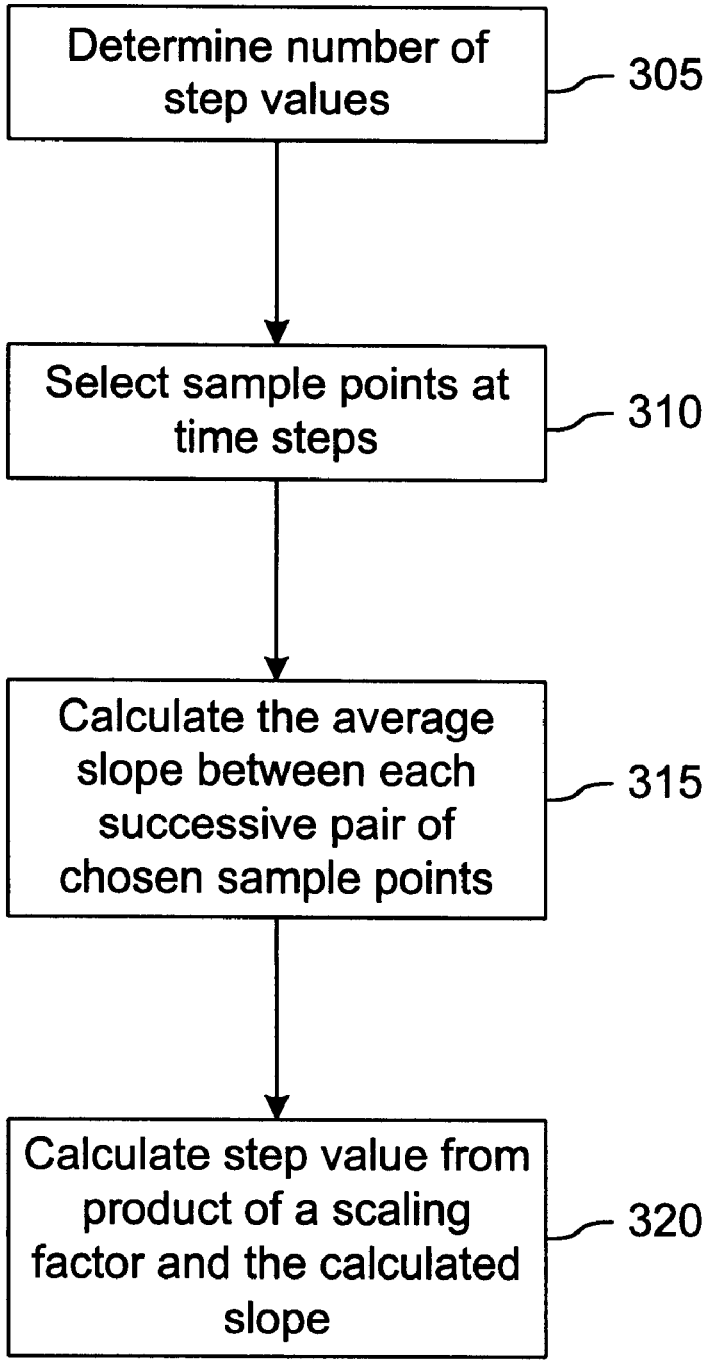
FIG. 3 is a flow diagram of a process for calculating the step values used by the Vramp generator of FIG. 1.

FIG. 3 shows a flow chart for calculating the step values for generating the Vramp signal. First, the number of step values to be stored in the memory 14 is determined (step 305). Then, sample points from the inverse gamma curve are selected (step 310). The number of sample points preferably corresponds to the number of step values to be stored. To select the sample points, an inverse gamma curve of a particular gamma factor may be mapped against the total number of clock cycles of an illumination period, such as 1024 cycles. The selection of the sample points may be adjusted according to the gamma factor. Since the curve for a higher gamma factor typically has more curvature at the early part of the curve, it is preferable for a curve with a higher gamma factor to have more sample points at the early part of the curve. In addition, the number of time cycles between each sample point preferably increases with time. For example, with reference to FIG. 2 and Table 1, sample points could be chosen at times T2, T4, T8, T16, and so on. In FIG. 2, only the sample points at T2, T4 and T8 are shown.

The sample points chosen at these times are points located on the actual inverse gamma curve, and the slope is calculated from a line connecting each pair of consecutive sample points. It is not necessary, however, to choose sample points located explicitly on the inverse gamma curve. In an alternative method, using time T2 as an example, a point could be chosen at T2 that is above the inverse gamma curve. The line connecting the chosen point at T2 to the point at T0 has an area between the line and the curve when the line is above the curve equal to the area between the line and the curve when the line is below the curve. This alternative method is intended to reduce the errors resulting from performing linear interpolation.

Once the sample points are chosen, slopes are calculated between each pair of consecutive sample points (step 315). For the slope between times T0 and T2, the slope is equal to $$\frac{\Delta Y1}{\Delta X1}.$$

ΔY1 corresponds to the difference in values of the points at T0 and T2, and ΔX1 corresponds to the change in time, which is two time cycles. By multiplying the calculated slope with a scaling factor, such as $$\left(\frac{2^{14}-1}{1024^{\frac{1}{\gamma}}}\right),$$

the step value used for the first and second time cycles is obtained (step 320). Since the first step value is used for the first two time cycles in a preferred embodiment, it is only necessary to store one value for the first two time cycles. The same holds for the step value calculated for the third and fourth time cycles. Since the same step value is used for the fifth through eighth time cycles, it is also only necessary to store one value for these four time cycles.

Using the above step value equation and an exemplary gamma factor value of 2.3, the following step values shown in Table II are calculated for the preferred embodiment.

TABLE II

| Step | | Step Value | | |
|---|---|---|---|---|
| Value Number | Sample Time | (Sub Calculation) | Rounded | in Hex |
| 1 | 0 | 543.78 | 544 | 220 |
| 2 | 2 | 191.25 | 191 | OBF |
| 3 | 4 | 129.26 | 129 | 081 |
| — | — | — | — | — |
| — | — | — | — | — |
| 31 | 896 | 7.36 | 7 | 007 |
| 32 | 960 | 7.08 | 7 | 007 |

Given a set number of step values, the only variable in calculating the step values is the selected gamma factor, γ. The step values that are loaded into the memory 14 may be generated using software or hardware, or some combination thereof. For example, an application specific integrated circuit (ASIC) could be designed to generate the step values when given the selected gamma factor. Alternatively, a software application may be developed that uses the available resources of a computer to make the calculation for generating the step values using the selected gamma factor, or to compute points for the inverse of some other brightness correction function.

Returning to FIG. 1, the control unit 12 creates and drives the control signals of the Vramp generator 10. Also, if memory 14 is composed of two or more storage units, control unit 12 may control the filling of the storage units while the Vramp generator 10 is continuously running. The control unit 12 may include a state machine to keep track of which storage unit in memory 14 is in use.

Another function of the control unit 12 is to regulate when new values are read from memory 14. The control unit 12 may refer to information in memory 14 or in another memory to keep track of the clock cycles to use each step value. The control unit 12 may include a state machine that uses the information stored in memory 14 or another memory to keep track of the clock cycles for which each step value is used. In one embodiment, each step value may be paired with a clock cycle, such that a step value is used as the increment if the clock cycle to which its paired is equal to the current clock cycle. In another embodiment, the value of the clock cycle may be used as the address to the memory 14 to indicate which step value is used.

Memory 14 preferably has at least 96 locations, 32 locations for each color. The process of loading the step values is not complete until all 96 locations in memory 14 are filled. If data are being loaded into one of multiple storage units of memory 14, the data are preferably unavailable for use until that storage unit is fully loaded.

The structure of the memory 14 may be a RAM, such as an SRAM, or a ROM, such as an EEPROM, and have a storage space of 96 words of 10 bits in length in a preferred embodiment. In addition, a built-in self test (BIST not shown) may be added. As discussed above, the use of two or more storage units for the memory 14 allows the loading of one while the other is in use. A BIST block, if added, is included to test memory 14. The memory 14 may be loaded using an interface and can be read using the same interface.

Figure 4:
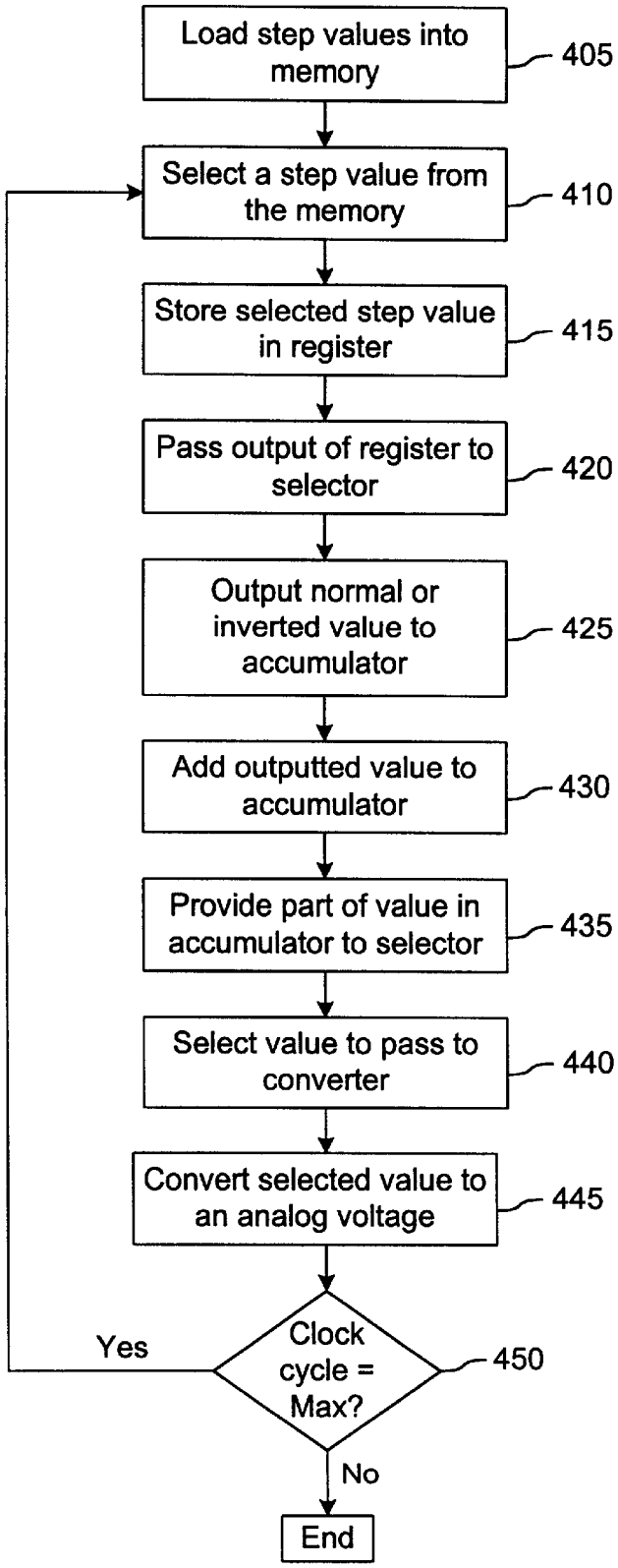
FIG. 4 is a flow diagram of a process for producing a Vramp_out signal from the Vramp generator of FIG. 1.

FIG. 4 is a flow diagram showing the process for calculating the Vramp_out signal of FIG. 1. First, the step values are loaded into memory 14 (step 405). Alternatively, if the step values are stored in a ROM, then no loading step is necessary. If the memory 14 includes multiple storage units, then the storage unit into which the step values are loaded is determined according to signals from the control unit 12. A step value from the memory 14 is then selected (step 410). In a preferred embodiment, the selected step value may have a 10 bit length. The value from the memory 14 that is output to the selector 18 is preferably selected in accordance with the address and clock signals from the control unit 12. As discussed above, the control unit 12 preferably controls which step value to output from the memory 14 and the time at which to output the appropriate step value. The value from the default value line 34 may be selected if the memory 14 has not yet been loaded with the step values. In general, the default value may be set as a constant increment determined by dividing the total increment by the number of time cycles.

The selected step value is output from selector 18 to register 22 (step 415). The output of register 22 is received by the selector 24 (step 420). Selector 24 receives both a normal value from register 22, as well as a value inverted by inverter 26. The selector 24 outputs the normal or inverted value to the accumulator 29 via an input 42 (step 425). The value is selected according to the add/subtract signal 36 from the control unit 12.

The accumulator 29 adds the value from selector 24 (step 430). The value from the selector 24 is added to the value stored in register 30 of the accumulator 29, which is passed to the input 46 of the adder 28. The adder 28 may be, for example, a 20-bit adder. Alternatively, the adder 28 may also be implemented as an arithmetic logic unit (ALU) that can add and subtract values or as any other circuit capable of performing two's complement subtraction. If the adder 28 is implemented as an adder, then the add/subtract signal 36 is applied to selector 24 so the subtraction operation is executed by adding the inverted value to the adder 28 and the add/subtract signal 36 is included as a carry-in. However, if the adder 28 is implemented as an ALU, then the add/subtract signal 36 need only be applied to the adder 28, and the inverter 26 and selector 24 would be unnecessary. The output of the adder 28 is placed in the register 30 and recycled back to an input 46 of the adder 28. Register 30 is, in a preferred embodiment, 20 bits in width.

Of the bits available from the accumulator 29, a selected number of the bits are provided to the selector 32 (step 435). In a preferred embodiment, of 20 bits stored in the register 30 of the accumulator 29, the lower 6 are maintained for precision of addition, the middle 8 are provided to the selector 32, and the top 6 are used to keep track of potential overflow, which is discussed below. The maximum possible sum is 1024 accumulated cycles multiplied by 1023 (the maximum increment). This value, in hexadecimal, is FFC00, which requires 20 bits to represent.

The bits that are output from the selector 32 are either all 1's if the force high line 50 is "on" or are equal to the selected number of bits from register 30 if the force high line 50 is "off" (step 440) and force low line 52 is "off." In a preferred embodiment, if the force high line 50 is "off," bits 13-6 (where bit 13 is the most significant bit) from register 30 are output by selector 32. The force high line 50, when "on," such as by being set to a logic "1" by control unit 12, forces the eight bits output by selector 32 to all be 1's. Similarly, if the value in accumulator 29 exceeds 01FFF, then force low line 52 is used to balance the time when force high line 50 is on and cause selector 32 to output all 0's.

The value output from the selector 32 provides the Vramp_out signal 11. This signal is passed to the DAC 60, which converts the digital signal corresponding to the Vramp_out signal into an analog voltage (step 445). The analog voltage corresponds to the Vramp signal 62 applied to the pixels of the display. The current clock cycle is then checked to see if it is the last clock cycle of the illumination or balance period (step 450). If it is the last one or maximum clock cycle, the process is complete for the particular Vramp period. If it is not the last one, then steps 410 through 445 are repeated. The step value selected in step 410 may be the same value as the previous time cycle or the next step value, depending upon the value of the current time cycle.

In a preferred embodiment, the Vramp_out signal 11 can be viewed as an 8-bit digital value that defines the level of the Vramp signal between Vmin and Vmax. Typically, the DAC 60 may be designed such that each of the bits of the Vramp_out signal turns on a voltage proportional to its size, with each of the turned on voltages being summed together to form the Vramp signal applied to the pixels of the display. For example, if Vmax is 3 volts, the most significant bit would turn on a voltage of 1.5V, the next one would turn on a voltage of 0.75 volts, and so on. There are other ways to produce the analog voltage of the Vramp signal from the Vramp_out signal, as is known in the art.

Alternatively, instead of passing the Vramp_out signal 11 to a digital-to-analog converter, the Vramp_out signal 11 itself may be applied to the pixels of the display. To use the Vramp_out signal 11 instead of the Vramp signal 62, the voltage stored for each pixel may be maintained as a digital value. The digital value corresponding to the stored voltage of a pixel is compared to the Vramp_out signal 11 to determine whether the pixel is on or off.

An additional register may be included in Vramp generator 10 to receive the value from selector 18. This allows the selected value, as well as other values stored in the memory 14, to be read while the Vramp generator 10 is in operation. A user can then fault check the value or values stored in the additional register to determine whether the proper value is being selected or if the loaded step values are correct.

The process of calculating step values as described in FIGS. 2 and 3 and of using these step values to generate the Vramp signal as described in FIGS. 1 and 4 allows an FLC display to use gamma correction while using a minimum amount of memory to store the step values used to generate the Vramp signal.

In addition to using the gamma correction, it is useful to maintain an average of 0V across the FLC material of a display. In FLC displays, the continuous application of an average voltage to the FLC material that is not 0V may cause the FLC material to have memory characteristics. To insure the bias on the FLC material averages to 0 volts, an illumination period is followed by a balance period. The illumination period is when the image is presented for display, while during the balance period, the image is dark. A voltage sequence is applied during the balance period that biases the FLC material in reverse of the voltage during the illumination period.

To achieve an average of 0V, the sense of the comparator is switched, and either the exact same Vramp signal or a Vramp signal mirrored about the Y-axis is used.

Balancing the voltage across the FLC material, i.e., maintaining an average of 0V, is achieved by an identical copy of the waveform, which is referred to as a saw-tooth waveform, or a monotonically decreasing Y-mirrored version, which is referred to as a triangle waveform. These alternatives allow a trade-off between image noise resulting from a saw-tooth Vramp signal and FLC bandwidth limits resulting from a triangle wave Vramp signal.

Figure 5A:
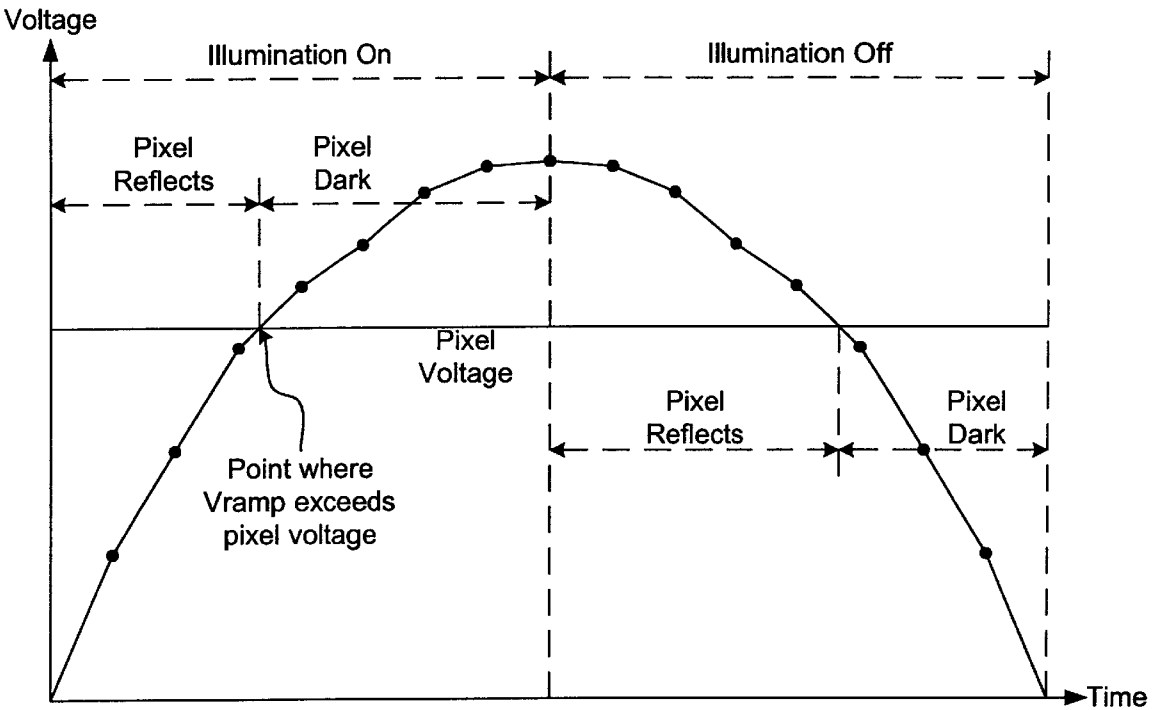
FIG. 5A is a graphical representation of a symmetrical inverse gamma curve used for balancing the voltage across the FLC material of a display.

FIG. 5A shows a graphical representation of a Y-mirrored version, i.e. triangle waveform, of the inverse gamma curve for balancing the voltage across the FLC material. As shown in FIG. 5A, the curve monotonically rises while the illumination of the display is on, which is referred to as the illumination period, and the curve monotonically falls while the illumination of the display is off, which is referred to as the balance period. Each pixel in the display has a comparator that compares the voltage stored in the pixel with the Vramp signal. During the illumination period, as long as the Vramp signal is less than the stored voltage of a pixel, the pixel will reflect, which is referred to as the on-state of the pixel. Once the voltage of the Vramp signal reaches the stored voltage of the pixel, the pixel stops reflecting and becomes dark, which is referred to as the off-state.

Figure 5B:
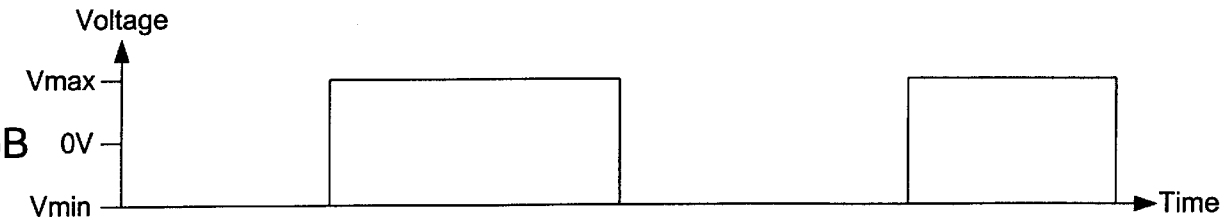
FIG. 5B is a graphical representation of the periods that a pixel is on or off for the graphical representation of FIG. 5A.

During the balance period, the sense of the comparator for each pixel is reversed. As a result, the pixel is in the on-state when the Vramp signal exceeds the stored voltage of the pixel and is in the off-state when the stored voltage of the pixel exceeds the Vramp signal. By equating the time that a pixel is on during the illumination period with the time a pixel is off during the balance period, the average voltage across the FLC material is maintained at 0V, as shown in FIG. 5B. In other words, the voltage across the FLC material is balanced by the illumination and balance periods.

Figure 6:
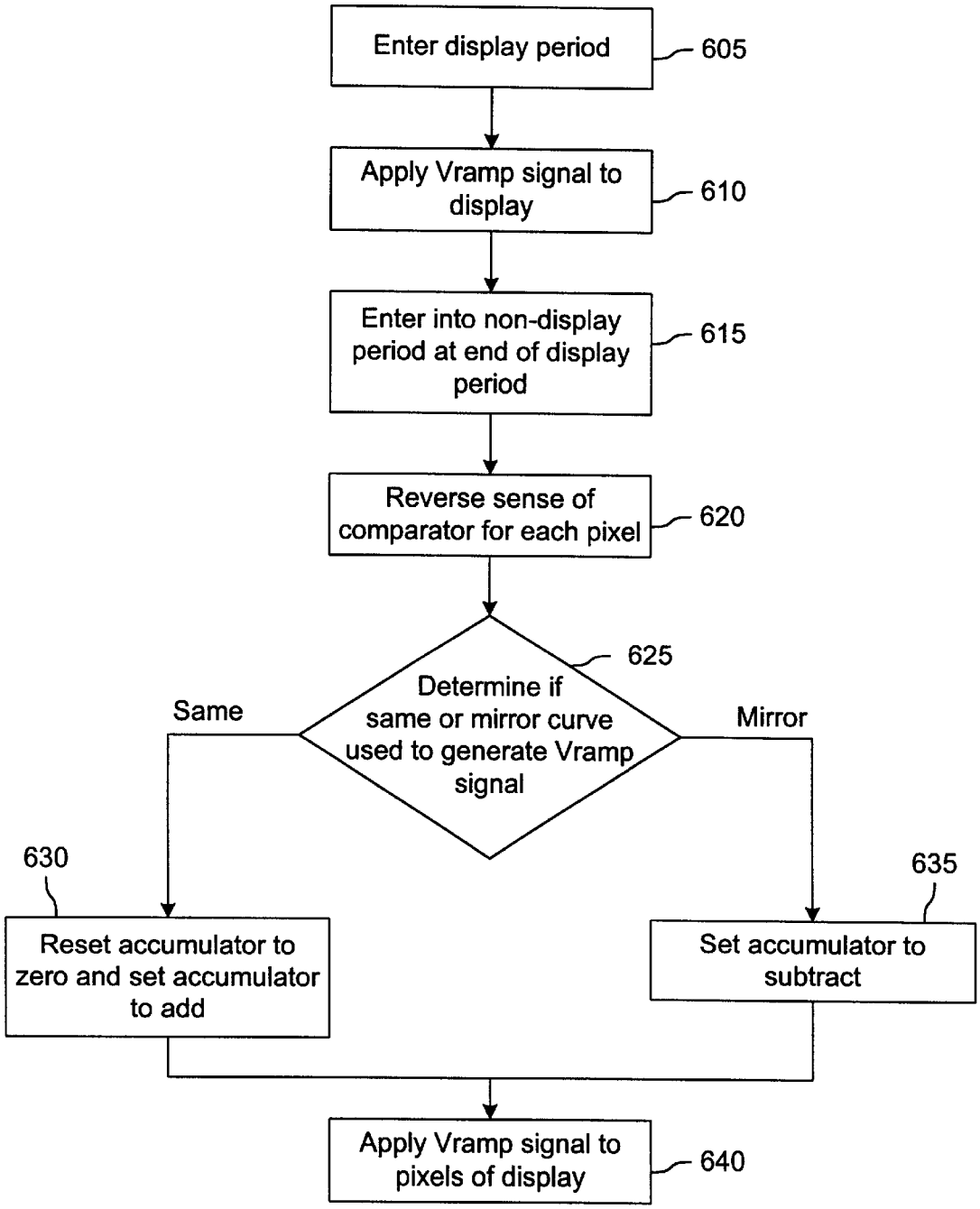
FIG. 6 is a flow diagram of a process consistent with the present invention for balancing the voltage across the FLC material.

FIG. 6 is a flow diagram for balancing the voltage across the FLC material of an FLC display, consistent with the present invention. First, the display enters the illumination period (step 605). In the illumination period, the Vramp signal is generated according to the step values processed in the Vramp generator 10 as previously described, and applied to the pixels of the display (step 610). At the end of the illumination period, the display enters into the balance period (step 615). At the beginning of the balance period, the sense of the comparator for each pixel is reversed (step 620).

In addition, at the beginning of the balance period, it is determined whether the same curve or a curve mirrored about the Y-axis is to be used (step 625). This determination could be performed by the control unit 12 of the Vramp generator 10, or the Vramp generator 10 could be hardwired or programmed to use either the same curve or a curve mirrored about the Y-axis. If the same curve is used, the control unit 12 resets the value in the accumulator 29 to zero and maintains the add/subtract line 34 at add (step 630). In this situation, the Vramp signal applied to the pixels in the balance period is identical to the Vramp signal applied to the pixels in the illumination period.

On the other hand, when the curve mirrored about the Y-axis is used, such as shown in FIG. 5, the control unit sets the add/subtract line 34 to subtract and does not reset the value in the accumulator 29 (step 635). As a result, the inverted form of the value from the selector 24 is supplied to the accumulator 29 so that each step value is subtracted from the value stored in the accumulator 29. Once the control signals are set, the Vramp signal is again applied to the pixels of the display (step 640).

When the curve mirrored about the Y-axis is used, the accumulator may need to be wider than the Vramp signal to account for an overflow condition. When calculating the Vramp_out signal, a situation may arise where the value of the Vramp_out signal 11 reaches its maximum value before the last cycle of the illumination period. If the accumulator 29 does not account for the overflow when the maximum value of the Vramp_out signal 11 is reached before the last time cycle of the illumination period, then the Vramp_out signal 11 produced during the balance period may be inaccurate. When using the same curve for both illumination and balance, additional bits are not required for the accumulator width because accounting for the overflow is unnecessary.

The following is an example of how the overflow condition may occur. Assume that the Vramp_out signal 11 reaches its maximum value at cycle number 1000, where the total number of cycles in the illumination period is 1024. For the next 24 cycles, the Vramp_out signal 11 remains at the same maximum value even though a step value is still being added to the accumulator 29 for each of the last 24 cycles. To properly balance the display during the balance period, the Vramp_out signal 11 should be at its maximum value for the first 24 cycles. If the value in the accumulator 29 does not account for the overflow, the value of the Vramp_out signal 11 will start to decrease after the first time cycle. By having the accumulator 29 account for the overflow, however, the value of the Vramp_out signal 11 will not decrease from its maximum value until after the $24^{th}$ cycle. The value of the Vramp_out signal will not decrease because, at the end of the illumination period, the value in the accumulator 29 will be greater than the maximum value of the Vramp_out signal 11 by the total sum of the step values added during the last 24 cycles. As a result, the value in the accumulator 29 will not correspond to the maximum value of the Vramp_out signal until after 24 cycles.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A method for generating a Vramp signal to be applied to pixels of a display, the method comprising:

providing a plurality of step values;

adding a first one of the step values to the Vramp signal for each of a first number of clock cycles;

adding a second one of the step values to the Vramp signal for each of a second number of clock cycles, different from the first number of clock cycles: and generating the Vramp signal in an illumination period and in a balance period, wherein each pixel of the display is in an on-state during the illumination period for the same amount of time each pixel is in an off-state during the balance period.

2. A device for generating a Vramp signal to be applied to pixels of a display, the device comprising:

a memory that stores a plurality of step values;

an adder that adds a first one of the step values to the Vramp signal for each of a first number of clock cycles and adds a second one of the step values to the Vramp signal for each of a second number of clock cycles, different from the first number of clock cycles;

a voltage generator that generates the Vramp signal in an illumination period and in a balance period; and each one of the pixels of the display is in an on-state during the illumination period for the same amount of time the one of the pixels is in an off-state during the balance period.

3. A device according to claim 2, wherein the first step value stored in the memory is generated based upon a slope between two sample points, which are selected in accordance with an inverse gamma curve having a selectable gamma factor.

4. A method for generating a gamma-corrected Vramp signal to be applied to pixels of a display, the method comprising:

determining a slope between consecutive pairs of sample points in accordance with a gamma factor of an inverse gamma curve;

calculating a step value for each determined slope;

adding one of the calculated step values to the Vramp signal each clock cycle;

generating the Vramp signal in an illumination period and in a balance period; and each one of the pixels of the display is in an on-state during the illumination period for the same amount of time the one of the pixels is in an off-state during the balance period.

5. A device for generating a gamma-corrected Vramp signal to be applied to pixels of a display, the device comprising:

a slope unit that determines a slope between consecutive pairs of sample points in accordance with a gamma factor of an inverse gamma curve;

a calculation unit that calculates a step value for each determined slope;

an adder that adds one of the calculated step values to the Vramp signal each clock cycle;

a voltage generator that generates the Vramp signal in response to an output of the adder, and generates the Vramp signal in an illumination period and in a balance period; and each one of the pixels of the display is in an on-state during the illumination period for the same amount of time the one of the pixels is in an off-state during the balance period.

6. A device according to claim 5, wherein:

the device additionally comprises a comparator that compares a stored voltage of each pixel with the Vramp signal; and a pixel is placed in an on-state when the comparator determines that a stored voltage of the pixel is greater than the Vramp signal during the illumination period, and places the pixel in an off-state when the comparator determines that a stored voltage of the pixel is greater than the Vramp signal during the balance period.

* * * * *